US005498123A

United States Patent [19]

Alicea

[11] Patent Number: 5,498,123

[45] Date of Patent: Mar. 12, 1996

[54] BOTTOM FEEDING MECHANISM

[75] Inventor: Carlos Alicea, Ronkonkoma, N.Y.

[73] Assignee: Macro Technology International, Inc., Ronkankoma, N.Y.

[21] Appl. No.: 328,145

[22] Filed: Oct. 24, 1994

[51] Int. Cl.[6] ..... B65G 59/06

[52] U.S. Cl. ..... 414/797.7; 414/797.6; 271/35; 271/125; 271/10.04

[58] Field of Search ..... 414/797.6, 797.7; 271/10, 35, 122, 124, 125, 10.01

[56] References Cited

U.S. PATENT DOCUMENTS

| | | | |
|---|---|---|---|
| 3,664,660 | 5/1972 | Runzi | 271/35 |
| 3,874,652 | 4/1975 | Bilbrey | 271/35 |
| 5,006,042 | 4/1991 | Park | 414/797.7 |
| 5,110,107 | 5/1992 | Bieber | 271/122 |
| 5,295,675 | 3/1994 | Hain | 271/122 |

*Primary Examiner*—Michael S. Huppert
*Assistant Examiner*—Douglas A. Hess
*Attorney, Agent, or Firm*—Cushman Darby & Cushman

[57] ABSTRACT

A bottom feeding mechanism comprises a feed roller assembly and a conveyor belt assembly functioning as a first stage gate and a set of snubber rollers functioning as a second stage gate. The feed roller assembly comprises a pair of feed rollers fixed on a shaft rotatably mounted on feeding bases and the conveyor belt assembly is situated in between the feed rollers and above the feed roller shaft. Apexes of the feed roller and the conveyor belt define the medium passage. The feed roller and the conveyor belt can only move unidirectionally, which are controlled by a driving means through one-way clutches. The snubber rollers are rotatably mounted on a bracket in an overlapping relation, i.e. one is over the other. Each snubber roller is independently driven. The upper snubber roller is driven by a torque-limited slip clutch device. When a medium is fed to hit the gate, vertical component of momentum of the feeding medium forces the conveyor belt deflecting the leading edge and opens up the gap to its proper opening to allow one piece of media to pass through. Should more than one piece pass through the first stage gate, the second stage gate will virtually eliminate the possibility of more than one piece passing through this gate, i.e. frictional torque between two piece is less than slip clutch torque, the upper roller rotates in the direction same as the lower snubber roller and drives the top piece backwards until it emerges from the roller set.

11 Claims, 7 Drawing Sheets

BOTTOM FEEDING MECHANISM

BACKGROUND OF THE INVENTION

1. Field of the Invention

This invention relates to a bottom feeding mechanism, in particular, to a mechanism for feeding media only one piece at a time to a functional unit, such as a printer.

2. Description of the Prior Art

An apparatus which peels off the bottom piece of a stack of media, for example, envelopes, and then feeds that piece to a functional unit to be processed is conventionally defined as a bottom feeder. The bottom feeder, in contrast with the top feeder which peels off the top of a stack of media, is capable of feeding media other than sheets of paper, say, envelopes. Commercially available bottom feeders have the following characteristics:

(1) The leading edge of the envelope stack rests on a rubber feeder roller.

(2) A mechanical gate above the feed roller is adjustable by the operator to assure that the gap is wide enough to feed a single piece but not wide enough for more than one piece to go through the gate.

(3) The roller is usually driven by a motor (typically, an A.C. motor) without proper feedback to control the velocity or position of the envelope.

The shortcomings of the above conventional bottom feeders can be understood by analyzing the physical properties of the envelope as follows:

(1) The envelope itself is a paper product, it absorbs or releases moisture from and to the air. As a result two things change, its thickness and surface properties (i.e. frictional coefficient).

(2) The envelope is also a pocket that traps air when stacked up collectively. The stack can be viewed as a group of compression springs connected in series. The bottom piece which is under the greatest load from above, is the thinnest and the top piece is the thickest.

Firstly, for a given envelope, thickness and friction coefficient between envelope and envelope/rubber feed roller are variable. A single gap adjustment is not sufficient to assure trouble free operation. In practice, the stack is limited in height, which may be two to three inches or approximately one to two hundred envelopes in business size. The tuning of the gate gap is time consuming and usually done on a trial error basis.

The second shortcoming is the prime mover itself. For an A.C. or a D.C. motor without proper feedback, the rotor speed depends on its payload. If the stack is high, the rotor is subjected to a greater retarding torque, hence its speed is less and gradually increases as the stack gets lower. A variable speed output from a high speed feeder could be potentially trouble-inviting. Paper jam is a common unpleasant experience for everyone in this field. To avoid unacceptable speed variation and to accomplish a very high burst speed (10,000 pieces up per hour), a very powerful motor is usually used. The potential trouble is reduced but not eliminated, the motor cannot be stopped quickly enough to avoid massive jams.

In summary, the weaknesses of the conventional bottom feeders are listed as follows:

(1) Manual adjustment of the gate gap is not enough to assure uninterrupted operation.

(2) Stack height is limited.

(3) Taking three pieces per second and 200 pieces of stacked envelopes as an example, the time for depleting the stack is a little longer than a minute. Attended operation is almost mandatory and cost of operating the machine goes up.

SUMMARY OF THE INVENTION

It is an object of the present invention to provide a bottom feeding mechanism comprising a feed roller assembly and a conveyor belt assembly functioning as a first stage gate, wherein the feed roller assembly comprises a pair of feed rollers fixed on a shaft rotatably mounted on feeding bases and the conveyor belt assembly is situated in between the feed rollers and above the feed roller shaft. The trailing shaft of the conveyor belt assembly is fixed and the leading shaft of which is floating and spring loaded toward a gate directly above the leading belt. Minimum gap between the gate and the belt is preset. Apexes of the feed rollers and the conveyor belt define the medium passage. The feed rollers and the conveyor belt can only move unidirectionally, which are controlled by a driving means through one-way clutches. When a medium is fed to hit the gate, vertical component of momentum of the feeding medium forces the conveyor belt deflecting the leading edge and opens up the gap to its proper opening to allow one piece of media to pass through.

It is another object of the present invention to provide a bottom feeding mechanism comprising a set of snubber rollers functioning as a second stage gate, wherein the snubber rollers are rotatably mounted on brackets in an overlapping relation, i.e. one is over the other. Each snubber roller is independently driven. The upper snubber roller is driven by a torque-limited slip clutch device. When the upper snubber roller is not in contact with anything or frictional torque is less than slip clutch torque, slip clutch does not slip and both snubber rollers rotate in the same direction. Should more than one piece pass through the first stage gate, the second stage gate will virtually eliminate the possibility of more than one piece passing through this gate, i.e. frictional torque between two piece is less than slip clutch torque, the upper roller rotates in the direction same as the lower snubber roller and drives the top piece backwards until it emerges from the roller set.

It is yet another object of the present invention to provide a bottom feeding mechanism comprising a ramp having a definitive step which is opposite to the gate forming a space for the stacking media, wherein the step is above the feeding path and the gate has an inclined wall of which the surface has fine sand paper like roughness. Trailing edge of the stack rests on the step and the trailing edge of the bottom medium will detach from the stack when it is pulled by the roller/belt assembly. The bulk weight of the Stack no longer applies to the bottom medium. As a result of such a separation, the possibility of feed roller slippage and multiple feeding can be greatly reduced. Also, when the stack is gradually depleted from the feeder, the rough surface of the gate can reduce the weight directly on the feed rollers and the free fall speed hence to induce more air in between the media.

These and other objects, advantages and features of the present invention will be more fully understood and appreciated by reference to the written specification.

DETAILED DESCRIPTION OF THE INVENTION

Figure 1:
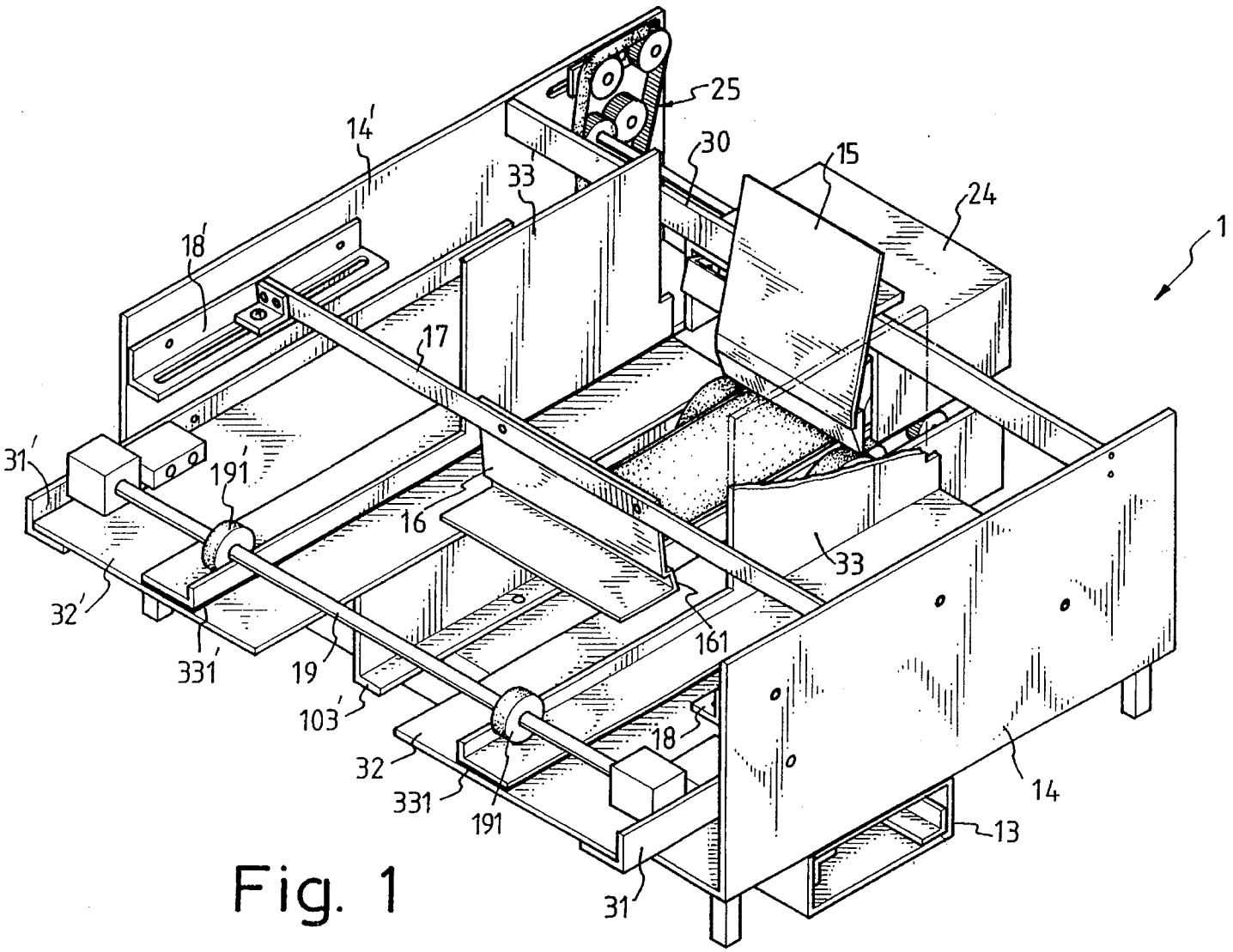
FIG. 1 is a perspective view of a bottom feeder.

Referring now to FIGS. 1, 2*a*, 2*b* and 6, a bottom feeder 1 is shown, which illustrates a bottom feeding mechanism according to the present invention comprising a feed roller assembly 10 and a conveyor belt assembly 12 functioning as a first stage gate. The feed roller assembly 10 comprises a pair of feed rollers 101, 101' fixed on a feed roller shaft 102 rotatably mounted on spaced L-shaped feeding bases 103, 103'. The feeding bases 103, 103' are fixed on a PC board box 13. The conveyor belt assembly 12 is situated in between the feed rollers 101, 101' and above the feed roller shaft 102. The conveyor belt assembly 12 comprises a leading shaft 121 and a trailing shaft 122 rotatably mounted on spaced guard plates 123, 123', wherein the trailing shaft 122 extends out of the guard plates 123, 123', and a conveyor belt 124 is trained over a leading roller 120 mounted on the leading shaft 121 and a trailing roller 120' mounted on the trailing shaft 122 and situated between the spaced guard plates 123, 123' directly above the horizontal portions of the feeding base 103, 103'. The trailing shaft 122 of the conveyor belt assembly 12 is fixed and the leading shaft 121 of which is floating and spring loaded toward a gate 15 directly above the leading belt 124 by a damping means 26. The damping means 26 comprises a support 261 mounted on the outside of the guard plate 123 and a plate spring 262 with one end attached to the bottom of the support 261 and the other end inclined downward and forward to come into contact with the horizontal portion of the feeding base 103.

Figure 3:
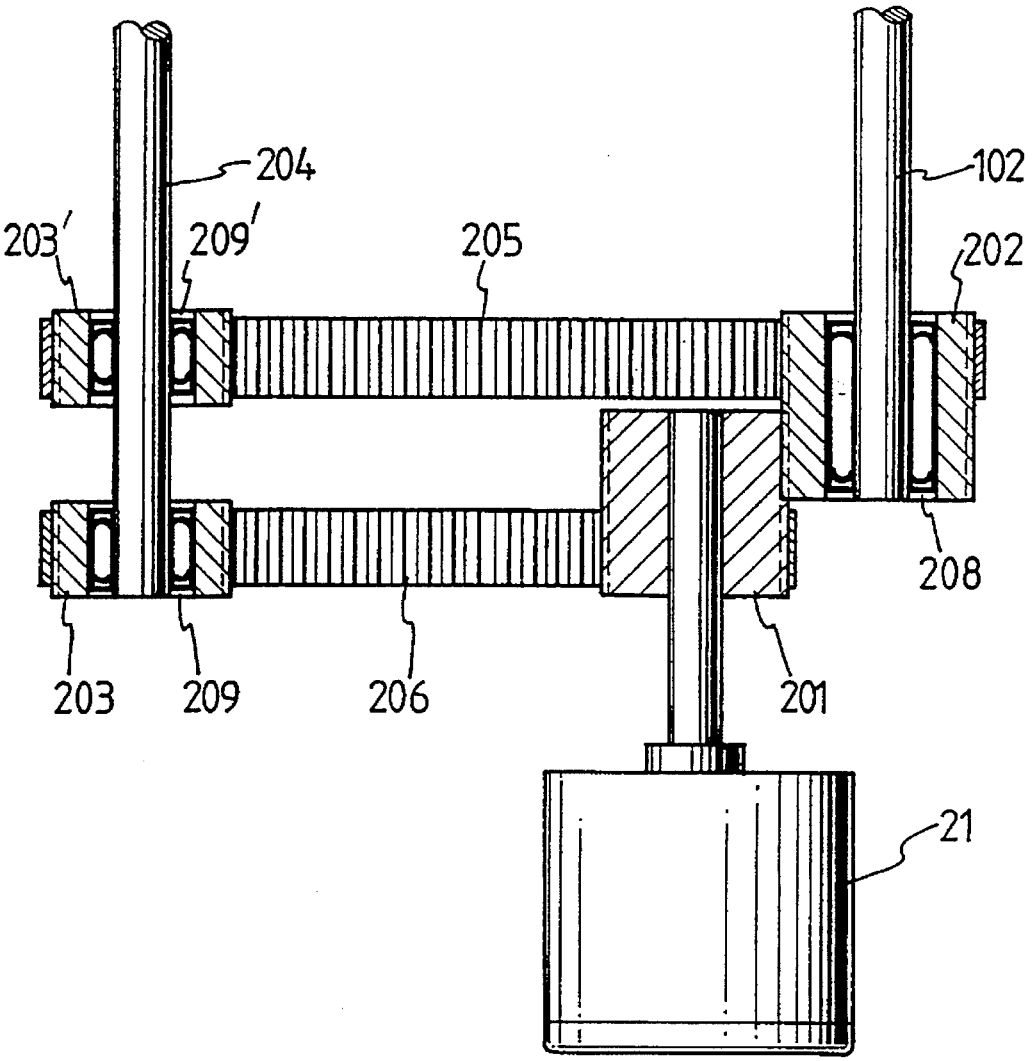
FIG. 3 is an enlarged cross-sectional view illustrating a combination of a driving means and a transmitting means.

A first transmitting means 20 connected to the feed roller shaft 102 is driven by a driving means 21 connected to a power supply (not shown). The driving means 21 can be a single D.C. stepping motor 21 bidirectionally controlled and used to accomplish all feeding motion. The first transmitting means 20 includes a driving gear 201 connected to the driving means 21, a driven gear 202 fixed on one end of the feed roller shaft 102 and partly engaged with the driving gear 201 in an offset arrangement, a pair of driven gears 203, 203' coaxially fixed on a driven shaft 204 mounted between the feeding bases 103, 103', a timing belt 205 trained over the driven gear 203' and a part of the driven gear 202, and a timing belt 206 trained over the driven gear 203 and driving gear 201. As shown in FIG. 3, a one-way clutch 208 is positioned between the feed roller shaft 102 and the driven gear 202, and a pair of ,one-way clutches 209, 209' are positioned between the driven shaft 204 and the pair of driven gears 203, 203', respectively.

The conveyor belt assembly 12 is also driven by the driving means 21. The driven shaft 204 is rotatably mounted on the spaced feeding bases 103, 103' below the conveyor belt assembly 12. One end of the driven shaft 204 is connected to the first transmitting means 20 and the other end thereof is connected to a second transmitting means 22. The second transmitting means 22 comprises a gear 221 fixed on the other end of the driven shaft 204, a gear 224 fixed on the trailing shaft 122 at one end, and a timing belt 225 trained over the gear 221 and the gear 224.

A set of snubber rollers 23, 23' functioning as a second stage gate are provided in brackets 24, 24' fastened to the bottom feeder 1 adjacent to the leading edge of the belt 124. The upper bracket 24 is fixed on a transverse bar 30 disposed between two side wall 14, 14' mounted on the PC board box 13. The lower bracket 24' with an extension 245 is mounted on a driven shaft 240 which passes through and locates between the feeding base 103, 103'. The lower bracket 24' is floating and spring loaded by a damping means 27. The damping means 27 comprises a support 271 mounted on the outside of the lower bracket 24' and a plate spring 272 with one end attached to the bottom of the support 271 and the other end inclined downward and forward to come into contact with the horizontal portion of the feeding base 103. The snubber rollers 23, 23' are rotatably mounted in an overlapping relation, i.e. one is over the other. Each snubber roller is independently driven. The upper snubber roller 23 is fixed on a two-piece upper driven shaft 231 near one end thereof. The upper driven shaft 231 itself is coupled by a torque-limited slip clutch 232 and rotatably mounted on the upper bracket 24. The distal end of the upper driven shaft 231 is mounted on the side wall 14'. A gear 251 is fixed on the upper driven shaft 231 near the inside of the side wall 14' and engaged with an idle gear 252 rotatably mounted on the side wall 14'.

A third transmitting means 25 comprises a pair of spaced gears 253, 253' rotatably mounted on a slider 254 shiftably along a grove 141 in the side wall 14' a gear 255 rotatably mounted on the side wall 14', a timing belt 257 trained over the pair of gears 253, 253' and gear 255 and selectively engaged with either the gear 251 or the idle gear 252, to rotate the upper driven shaft 231 a gear 250 fixed on a driven shaft 240 at one end, a timing belt 258 trained over the gear 255 and the gear 250, and a timing belt 259 trained over the gear 250 and gear 221. The lower snubber roller 23' is fixed on a lower driven shaft 241 rotatably mounted on the lower bracket 24'. The lower driven shaft 241 extends out of the lower bracket 24'. A fourth transmitting means comprises a driven gear 242 fixed on the extension end of the lower driven shaft 241, a corresponding driving gear 243 fixed on the driven shaft 240, and a timing belt 244 trained over the driving gear 243 and the driven gear 242.

It should be noted that the bearings, supports and the like which must necessarily be provided with respect to the functional members of the bottom feeding mechanism not shown or described in detail aims to simply and more clearly depict the mechanism. It should be understood that such details would be obvious to persons of ordinary skill in this art.

Figure 2A:
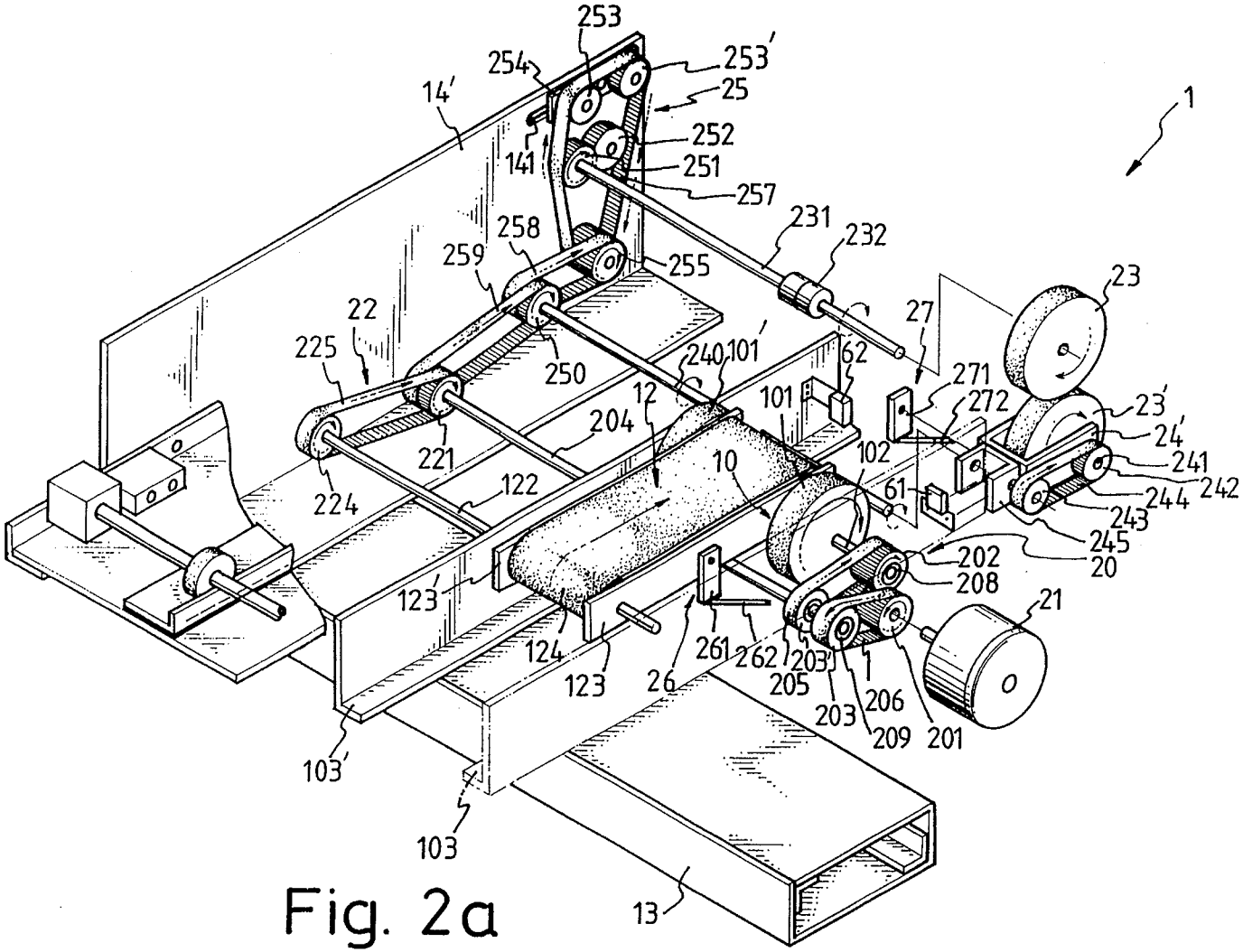
FIG. 2*a* is a perspective view illustrating a bottom feeding mechanism according to the present invention in detail, wherein a motor contained therein rotates in a counterclockwise direction.
Figure 2B:
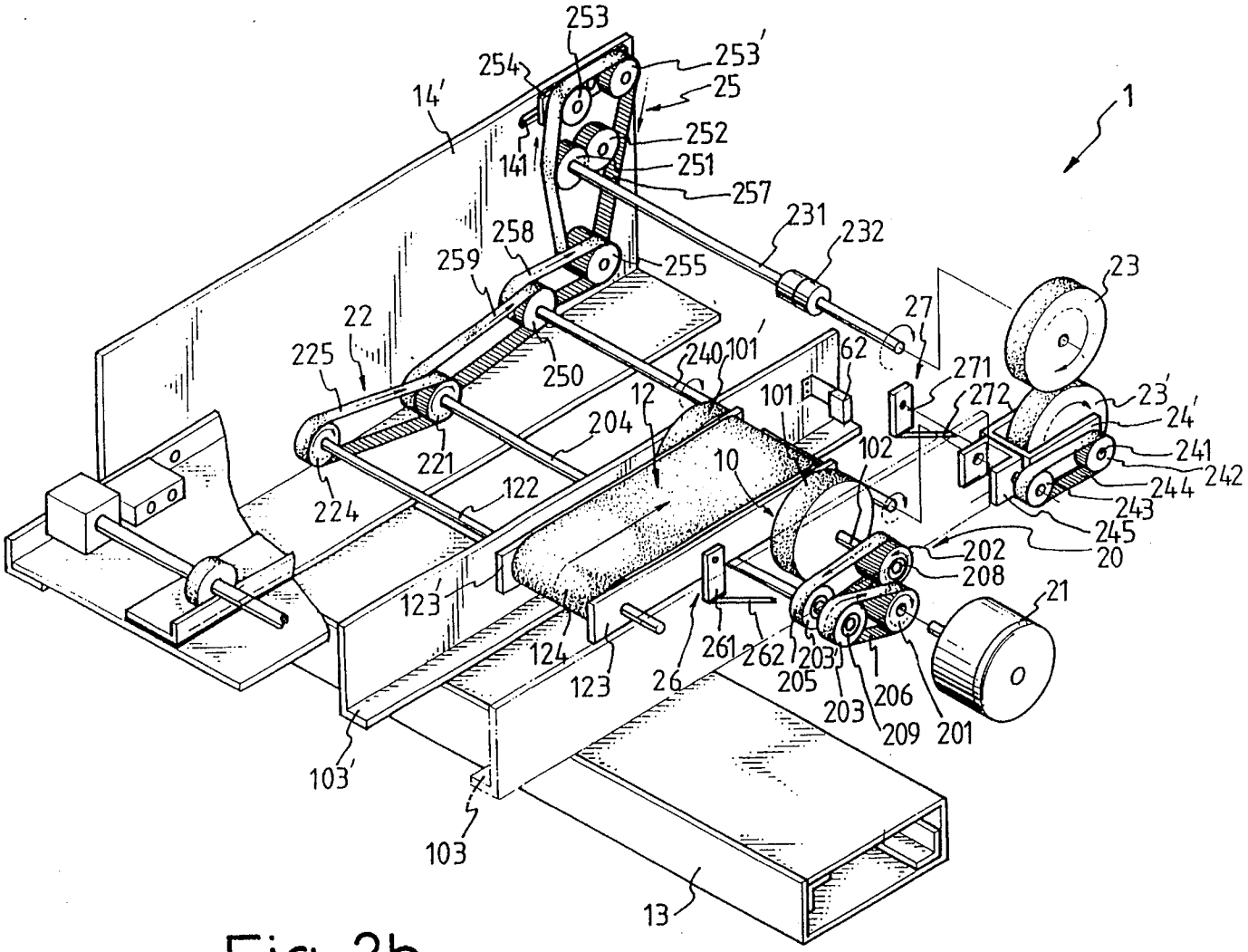
FIG. 2*b* is a perspective view illustrating a bottom feeding mechanism according to the present invention in detail, wherein a motor contained therein rotates in a clockwise direction.

In FIG. 2*a*, as the motor 21 drives the driving gear 201 to rotate counterclockwise, the driven gear 202 rotates clockwise and the one-way clutch 208 between the feed roller shaft 102 and the driven gear 202 engages, the feed roller shaft 102 then rotates clockwise, on the other hand, the driving gear 201 drives the driven gear 203 to rotate counterclockwise by the timing belt 206, the one-way clutch 209 between the driven shaft 204 and the driven gear 203 disengages, however, the driven gear 202 drives the driven gear 203' to rotate clockwise by the timing belt 205, the one-way clutch 209' between the driven shaft 204 and the driven gear 203' engages and the driven shaft 204 rotate clockwise such that feed rollers 101 and conveyor belt 124 rotates clockwise. In FIG. 2*b*, as the motor 21 drives the driving gear 201 to rotate clockwise, the driven gear 202 rotates counterclockwise and the one-way clutch 208 between the feed roller shaft 102 and the driven gear 202 disengages, the feed roller shaft 102 idles, on the other hand, the driven gear 202 drives the driven gear 203' to rotate counterclockwise by the timing belt 205, although the one-way clutch 209' between the driven shaft 204 and the driven gear 203' disengages, the driving gear 201 drives the driven gear 203 to rotate clockwise by the timing belt 206, the one-way clutch 209 between the driven shaft 204 and the driven gear 203 engages and the driven shaft 204 rotate clockwise. The rotation direction of the motor 21 can be controlled such that the feed rollers 101 and the conveyor belt 124 simultaneously try to peel off the bottom piece from the beginning, and then only the conveyor belt 124 moves forward when the leading edge of the piece passes through the gap.

Figure 4A:
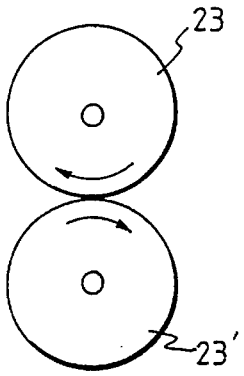
FIGS. 4*a* through 4*c* are schematic views illustrating different rotation states of snubber rollers.
Figure 4B:
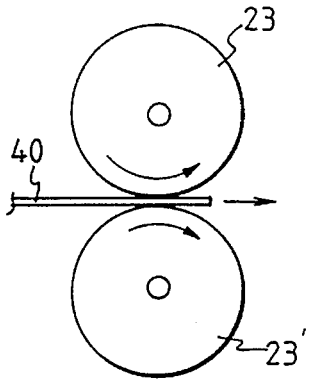
Figure 4C:
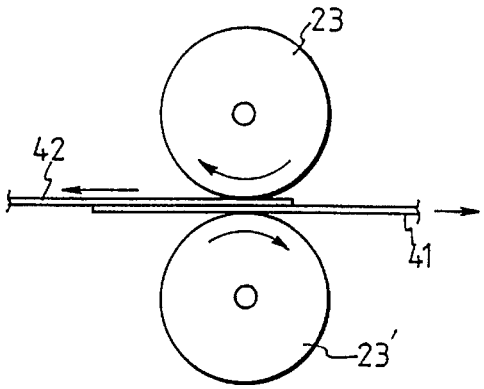

Referring now to FIGS. 4*a* through 4*c*, different rotation states of the snubber rollers 23, 23' are shown. In FIG. 4*a*, when the upper snubber roller 23 is not in contact with anything, the slip clutch 232 does not slip. Both snubber rollers 23, 23' rotate clockwise. In FIG. 4*b*, when two snubber rollers 23, 23' come into contact with each other or one piece 40 of media in between the snubber rollers 23, 23' (normal feeding), frictional torque between that piece 40 and the upper snubber roller 23 or between snubber rollers 23, 23' overrides the slip clutch 232, and the slip clutch slips. The lower snubber roller 23' rotates clockwise and the upper snubber roller 23 rotates counterclockwise to facilitate feeding. In FIG. 4*c*, if multiple feeding occurs, say two pieces 41, 42 of media (abnormal feeding), frictional torque between the two pieces 41, 42 is less than slip clutch torque, the slip clutch 232 does not slip. The lower snubber roller 23' rotates clockwise to drive the bottom piece 41 forewords and the upper snubber roller 23 rotates clockwise to drive the top piece 40 backwards until it emerges from the snubber roller assembly.

Figure 5A:
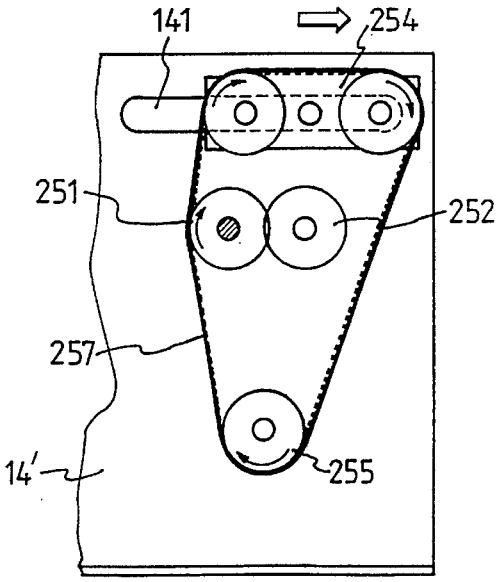
FIGS. 5*a* and 5*b* are schematic views illustrating two different positions of a transmitting means mounted on a side wall of a bottom feeder.
Figure 5B:
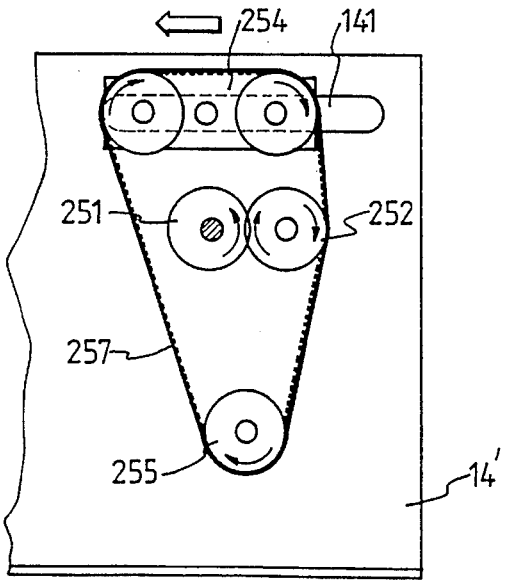

In this invention, for even thicker media (i.e. booklet) with open end as leading edge, multiple feeding is usually not likely to happen. With reference to FIGS. 5*a* and 5*b*, the slider 254 can be shifted by an operator to convert the rotation direction of the upper snubber roller 23, i.e. from the clockwise direction (FIG. 5*a*) to counterclockwise direction (FIG. 5*b*). This change of direction enables the positive grip of media to prevent any slippage between layers of multiple sheets of the media.

Figure 6:
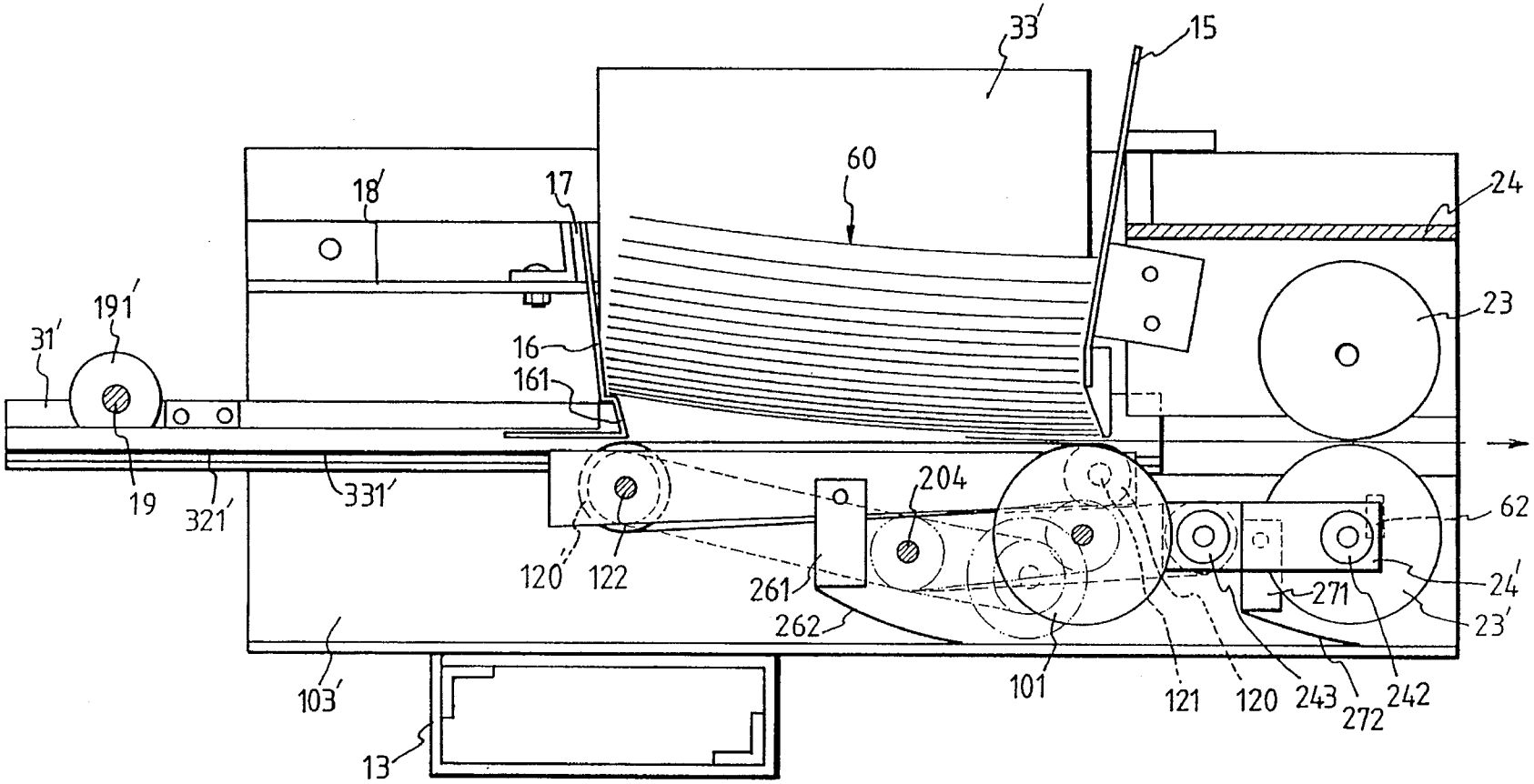
FIG. 6 is a cross-sectional view of a bottom feeder.

To assure the maximum stack of media can be loaded without stalling a given motor, passive components are introduced to reduce the interaction between media which results from the self weight of the stack of media. In FIG. 6, the gate 15 is attached to the upper bracket 24 by known means above the leading belt 124. The gate 15 has an inclined wall of which the surface has fine sand paper like roughness. A ramp 16 having a definitive step 161 opposite to the gate 15 and above the feeding path forming a space for stacking media is fixed on a bar 17 movably straddled on rails 18, 18' provided horizontally along the side walls 14, 14'. A pair of channel bars 31, 31' are fastened to the side walls 14, 14', respectively. A pair of steel plates 32, 32' are fixed on the channel bars 31, 31', respectively. A pair of adjusting plates 33, 33' are movably disposed on the steel plates 32, 32', respectively. Each of the adjusting plate 33 (33') is provided with a magnetic stripe 331 (331') on the bottom to adhere to the steel plate 33 (33'). The adjusting plates 33, 33' can be horizontally shifted along the steel plates 32, 32' and be fixed by a pair of retainers 191, 191' provided on a positioning bar 19 disposed between the channel bars 31, 31' in association with the movably ramp 16 for receiving different size media. Considering a stack of envelopes 60 with its leading edge resting on the apexes of the feed roller 101 and the conveyor belt 124, the gap of the first stage gate is set a less than the thickness of the envelope 60. When an envelope 60 is fed to hit the gate 15, vertical component of momentum of the feeding envelope forces the conveyor belt 124 deflecting the leading edge and opens up the gap to its proper opening to allow one piece of envelope to pass through. It should be noted that the trailing edge of the stack rests on the step 161 and the trailing edge of the bottom envelope will detach from the stack when it is pulled by the roller/belt assembly. The bulk weight of the stack no longer applies to the bottom envelope. As a result of such a separation, the possibility of feed roller slippage and multiple feeding can be greatly reduced. Also, when the stack is gradually depleted from the feeder, the rough surface of the gate 15 can reduce the weight directly on the feed rollers 101 and the free fall speed hence to induce more air in between the envelopes.

Figure 7:
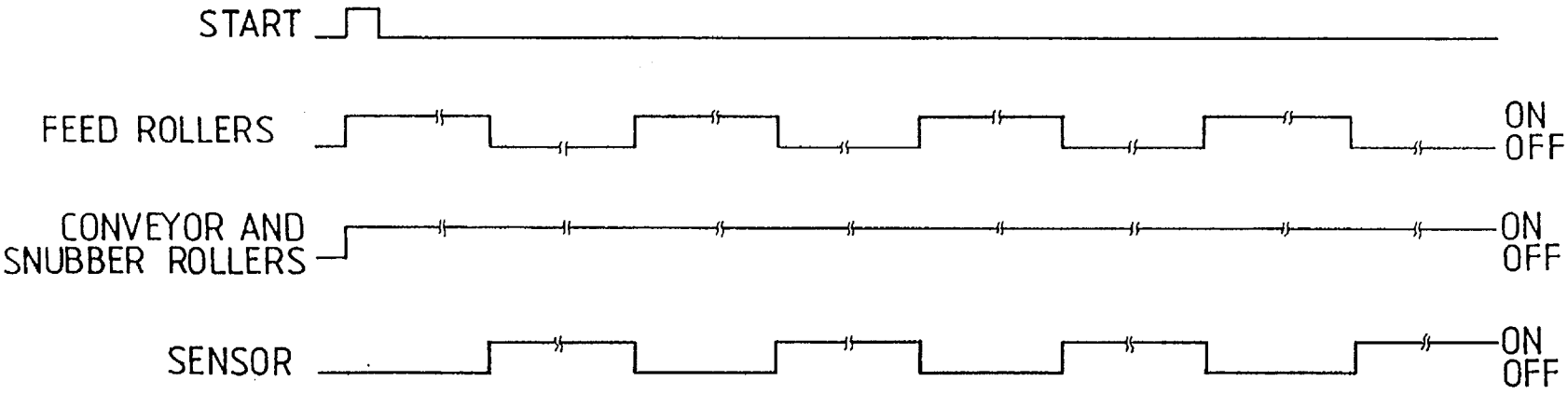
FIG. 7 is a timing diagram of a bottom feeder.

Commands to motion or signals from detecting means are all processed through a microprocessor (not shown) embedded in the bottom feeder 1. The microprocessor controls all the paper handling and jam detection functions and is capable of communicating with an external device (i.e. printer, labeler, taber, etc.) to which media are being fed to. As shown in FIGS. 2*a* and 6, a reflective sensor 62 mounted on the feeding base 103' near the lower snubber roller 23' under the feeding path is used to control paper motion. With reference to FIG. 7, a description of the timing sequence for the feed rollers, conveyor and snubber rollers are as follows:

Event 1:

The feeder receives a command to feed.

Event 2:

Feed rollers, conveyor and snubber rollers rotate to feed a piece of media to the snubber rollers.

Event 3:

When the sensor detects the leading edge of the piece, that is, the piece has reached the snubber rollers. The feed rollers stop, the conveyor and the snubber rollers continue rotating. This is done to prevent a second piece of media to follow the first one without a gap.

Event 4:

When the sensor detects the trailing edge of the piece, it is clear to feed the next piece. At this time we go back to event 2. This will create a gap between the pieces of media equal to or less than the distance between feed and snubber rollers.

If paper does not arrive at the sensor within a predetermined time window, the embedded microprocessor determines that there is a fault condition and stops the paper motion.

While the structure and features of the present invention have become more apparent from the above detailed description and illustration, it is to be understood that the embodiment has been described only by way of illustrating the preferred operation of the present invention without limiting the scope of the present invention. Therefore, it is intended that any modifications and changes that can be made to the embodiment without departing from the spirit of the present invention are within the scope as set forth in the appended claims.

I claim:

1. A bottom feeding mechanism for feeding a stack of media comprising:

a pair of spaced feeding bases;

a feed roller assembly including a pair of feed rollers fixed on a feed roller shaft rotatably mounted on the feeding bases;

a pair of guard plates situated between the feeding bases;

a conveyor belt assembly including a leading shaft and a trailing shaft rotatably mounted on the guard plates, and a conveyor belt trained over the leading shaft and the trailing shaft and situated between the guard plates;

a gate directly positioned above the belt near its leading edge;

a bidirectionally controlled driving device;

a first transmitting means for transmitting a rotation from the driving device to the feed roller shaft; and a second transmitting means for transmitting a rotation from the first transmitting means to the trailing shaft of the conveyor belt assembly;

whereby the feed rollers and the conveyor belt are independently driven and move unidirectionally to feed one piece of medium at a time.

2. A bottom feeding mechanism as claimed in claim 1 further comprising:

a pair of brackets including an upper bracket and a lower bracket positioned adjacent to a leading edge of the conveyor belt in an overlapping arrangement;

a set of snubber rollers including an upper snubber roller fixed on an upper shaft and a lower snubber roller fixed on a lower shaft, and the upper and lower shafts being rotatably mounted on the brackets in an overlapping relation;

a third transmitting means for transmitting a rotation from the first transmitting means to the upper snubber roller; and a fourth transmitting means for transmitting a rotation from the third transmitting means to the lower snubber roller;

whereby the snubber rollers are independently driven to feed a piece away from the feed rollers and the conveyor belt.

3. A bottom feeding mechanism as claimed in claim 2 further comprising a torque-limited slip clutch connected between the upper snubber roller and the third transmitting means for controlling the rotation direction of the upper snubber roller.

4. A bottom feeding mechanism as claimed in claim 1, wherein the first transmitting means includes a driving gear connected to the driving device, a first driven gear fixed on one end of the feed roller shaft and partly engaged with the driving gear in ah offset arrangement, a pair of second driven gears coaxially fixed on a driven shaft mounted between the feeding bases and connected to the second transmitting means, a first timing belt trained over one of the second driven gear and a part of the first driven gear, and a second timing belt trained over the other second driven gear and the driving gear.

5. A bottom feeding mechanism as claimed in claim 4 further comprising a first one-way clutch positioned between the feed roller shaft and the first driven gear, and a pair of second one-way clutches positioned between the driven shaft and the pair of second driven gears, respectively.

6. A bottom feeding mechanism as claimed in claim 4, wherein the second transmitting means comprises a first gear fixed on the other end of the driven shaft, a second gear fixed on the trailing shaft at one end, and a third timing belt trained over the first and second gears.

7. A bottom feeding mechanism as claimed in claim 1 further comprising a ramp having a definitive step which is opposite to the gate forming a space for stacking media, wherein the step is above a feeding path and the gate has an inclined wall of which the surface has fine sand paper like roughness.

8. A bottom feeding mechanism as claimed in claim 2, wherein the third transmitting means comprises a driven shaft rotatably mounted on the feeding bases through the lower bracket, and the fourth transmitting means comprises a driven gear fixed on the lower shaft at one end, a corresponding driving gear fixed on the driven shaft, and a timing belt trained over the driving gear and the driven gear.

9. A bottom feeding mechanism as claimed in claim 3 further comprising a sensor mounted on one of the feeding base near the lower snubber roller, whereby the sensor detects a leading edge of a piece of media, the feed rollers stop, the conveyor and the snubber rollers continue rotating; whereby the sensor detects a trailing edge of the piece, another piece is fed repeatedly.

10. A bottom feeding mechanism as claimed in claim 1, further including a damping structure associated with the leading shaft, and wherein the trailing shaft of the conveyor belt assembly is fixed and the leading shaft of which is floating and spring loaded toward the gate by said damping structure.

11. A bottom feeding mechanism as claimed in claim 10, wherein the damping structure comprises a support mounted on an outside of a guard plate and a plate spring with one end attached to a bottom of the support and the other end inclined downward and forward so as to come into contact with a horizontal portion of one of the feeding bases.

* * * * *